United States Patent [19]

Dempsey

[11] Patent Number: 4,715,346

[45] Date of Patent: Dec. 29, 1987

[54] CARBURETOR FOR INTERNAL COMBUSTION ENGINE

[76] Inventor: Beth R. Dempsey, 8249 Standifer Gap Rd., Chattanooga, Tenn. 37421

[21] Appl. No.: 851,570

[22] Filed: Apr. 14, 1986

[51] Int. Cl.[4] ..... F02M 15/02; F02M 17/26

[52] U.S. Cl. ..... 123/524; 123/549; 123/593; 261/36.2; 261/79.1; 261/100; 261/142

[58] Field of Search ..... 123/523, 524, 548, 549, 123/557, 591, 593; 261/36.2, 79.1, 100, 142

[56] References Cited

U.S. PATENT DOCUMENTS

| | | | |
|---|---|---|---|
| 1,046,653 | 12/1912 | Ruthven | 261/100 X |
| 2,590,377 | 3/1952 | Cater | 261/36.2 X |
| 2,633,836 | 4/1953 | Cox | 123/591 X |
| 3,872,191 | 3/1975 | Walcker | 123/543 X |
| 3,957,468 | 5/1976 | Voth et al. | 261/362 X |
| 4,412,521 | 11/1983 | Silva, Jr. | 123/523 X |
| 4,448,175 | 5/1984 | Darvial et al. | 123/523 X |

*Primary Examiner*—Tony M. Argenbright
*Attorney, Agent, or Firm*—Alan Ruderman

[57] ABSTRACT

A carburetor for an internal combustion engine has a long multi-stage mixing path for the air and fuel to completely mix, the path being formed by three mixing chambers arranged vertically in tandem. Each chamber has a spirally extending pathway. The air and liquid fuel is sprayed into an outer portion of the top chamber and flows toward the central portion to enter the next adjacent chamber at the center, and continues to flow in the pathway in the second chamber spirally outwardly to enter the pathway in the third chamber at an outer portion from which it flows toward the center of the third chamber out the carburetor into the intake manifold of the engine. The first chamber has a cyclonic funnel in the central portion thereof so that the less volatile heavy unvaporized liquid fuel particles flowing in the first chamber are collected in a reservoir disposed at the bottom of the funnel. The collected fuel is drawn out of the reservoir to a heater outside the chambers, heated and returned to the center of the first chamber to enter the second chamber with the air and fuel mixture exiting the first chamber. The pathways in each chamber have a series of spaced turbulence producing screen panels which aid in the mixing process.

15 Claims, 3 Drawing Figures

CARBURETOR FOR INTERNAL COMBUSTION ENGINE

BACKGROUND OF THE INVENTION

This invention relates to carburetors for internal combustion engines and more particularly to a carburetor having more complete vaporization of the fuel and mixing of the fuel with air so as to provide more efficient and complete combustion than prior art caburetors.

It is well known that unvaporized fuel does not completely mix with air and does not result in complete combustion when delivered to the combustion chamber of an internal combustion engine. In most carburetor systems the liquid fuel, e.g., gasoline, is atomized into the air stream to produce a mixture of air and a fine fuel mist or minute droplets of liquid fuel. The result is that combustion in engines using such systems is incomplete and the engines typically are inefficient and exhaust substantial pollutants.

Much effort has been expended in the prior art to develop a carburetor system having more complete vaporization of the fuel and mixing of the fuel with air. Some attempts have been made to provide more finely atomized fuel while others have pre-heated the fuel to vaporize it. One of the problems encountered with these attempts is that gasoline is a petroleum based mixture comprising a number of highly volatile and less volatile hydrocarbon components and additives. The lighter higher volatile components vaporize readily when atomized while the heavier components require an input of more kinetic energy to obtain sufficient molecular agitation for vaporization. Various turbulence producing constructions have been proposed for producing such agitation. In certain of the prior art the fuel is heated prior to entry into the intake manifold. For example, in Walcker U.S. Pat. No. 3,872,191 fuel is sprayed onto a heated screen through which air is directed for mixing with the fuel which is vaporized and the mixture is subsequently passed to a turbulence producing chamber. The heavier non-volatile liquid components are collected and recycled. However, the recycling of the heavy liquids eventually will result in a build-up of a heavy viscous residue and the longer the engine runs the greater will be the residue. In Silva, Jr. U.S. Pat. No. 4,412,521 air is bubbled and percolated through the fuel in a vaporizer to pick up fuel and is thereafter heated and mixed with additional air while unmixed liquid particles of fuel are returned to the vaporizing chamber. This unmixed heavy liquid is recycled and will continue to build-up until a highly viscous residue will result. In Darvial, et al, U.S. Pat. No. 4,448,175 heating of the vaporized fuel and air occurs while the heavier liquid components of the fuel are collected in a reservoir. In none of the known prior art has the heavy components of the fuel been vaporized to the point such as to provide for complete combustion of the fuel.

SUMMARY OF THE INVENTION

Consequently, it is a primary object of the present invention to provide a carburetor in which vaporization of the fuel and mixing of the fuel with air is more complete than in the prior art.

It is another object of the present invention to provide a carburetor having a substantially long turbulence producing path along which the fuel and air flow so as to provide sufficient time and agitation for vaporizing the fuel and for mixing the fuel and air required for combustion.

It is a further object of the present invention to provide a carburetor having a substantially long turbulence producing path for vaporizing the volatile components of the fuel and mixing the fuel vapors with air, separating the heavy components of the fuel from the readily vaporized components, recapturing and heating these heavy components, and returning the heavy components so recaptured into the volatile gases for mixing therewith prior to the latter exiting the mixing process in the carburetor.

Accordingly, the present invention provides a carburetor which utilizes a long multi-stage mixing path for the air and the more volatile fuel components and a cyclonic action in the path to separate the less volatile heavier components of the fuel in an early stage and thereafter recirculates these heavier components into a later stage after heating them into an agitated state where the molecular activity is sufficient for more ready vaporization thereof. To this end the present invention provides a carburetor having a plurality of chambers arranged vertically in tandem, the air and raw fuel entering into the top chamber are directed in a decreasing radius spiral path through turbulence producing elements in the chamber until the mixture is at the central portion. The air and vaporized fuel continue flowing over a baffle adjacent a cyclonic funnel at the center of the top chamber and flow into the subsequent chambers in seriatim while the heavier unvaporized less volatile liquid fuel particles collect in a reservoir about the funnel. The collected liquids are continually removed from the reservoir, heated outside the carburetor and directed to reenter the carburetor at the center of the funnel into the subsequent chambers in seratim for mixing with the more volatile gases flowing from the first chamber. In the second chamber the evaporation and mixing continues as the mixture flows in a spiral path of increasing radius through additional turbulence producing elements and exits through a channel at the outer periphery of the second chamber to enter a third chamber where it flows through further turbulence producing elements in a spiral path toward the center where it may exit the carburetor and enter the intake manifold of an engine or may flow through additional chambers in a similar manner.

In the preferred form of the invention the chambers are in the form of trays mounted one on the other for forming flow channels for the gases, and the turbulence producing elements comprise a series of perforated or screen panels. The trays are nested within an air filter and carried within a housing or shell so that the intake air flows through the air filter in a conventional manner prior to entry into the carburetor intake. Preferably the heater heats the less volatile fuel received from the reservoir to a temperature of at least approximately 300° F. for vaporization of these heavy components to occur readily.

It has been found that when a carburetor of this construction is utilized in conjunction with an automobile engine the combustion efficiency increased substantially and approximately doubled the gasoline mileage while reducing the pollution exiting from the engine.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
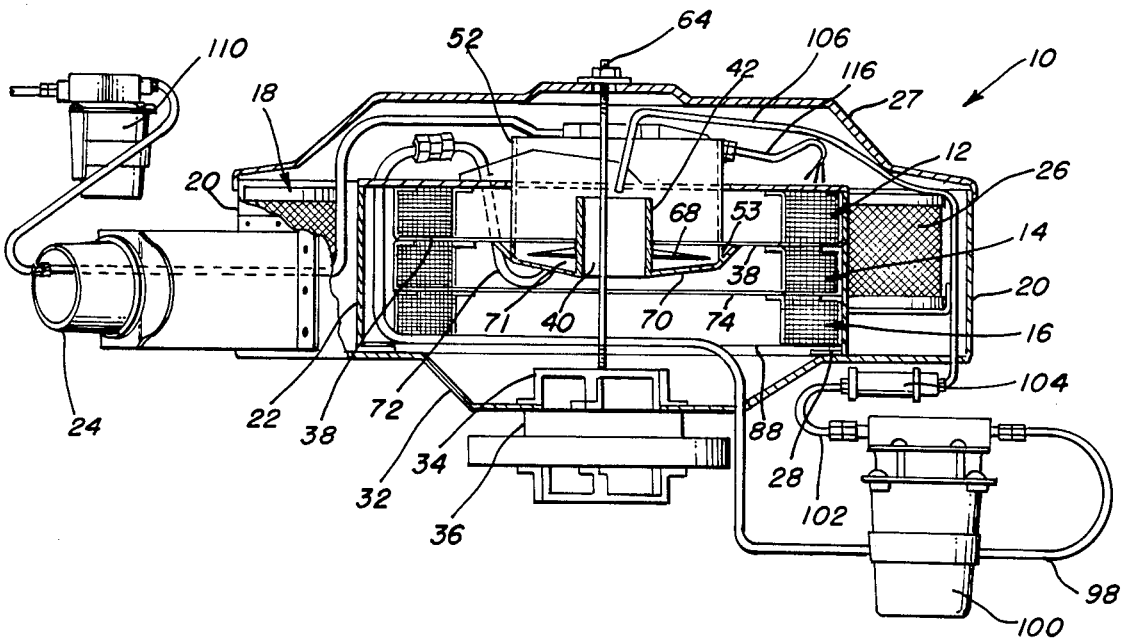
FIG. 1 is a vertical cross sectional view of a carburetor constructed in accordance with the present invention and the air filter mounting shell within which the carburetor is disposed illustrated on the intake manifold of an internal combustion engine.
Figure 3:
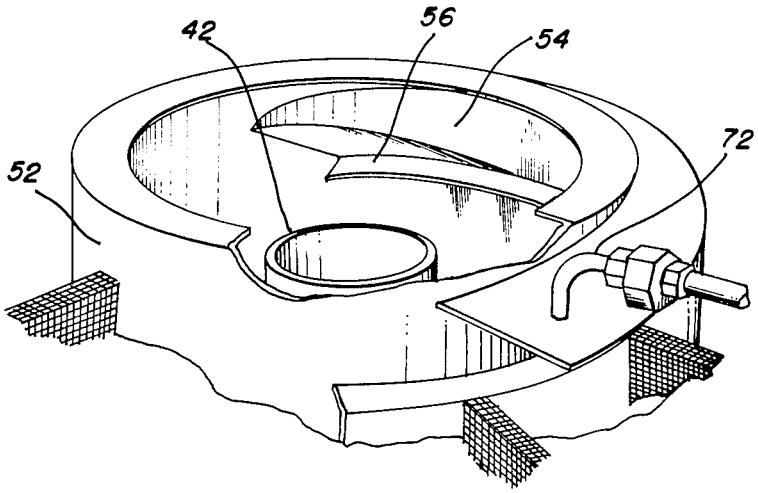
FIG. 3 is a fragmentary perspective view of a portion of the carburator with parts thereof broken away to illustrate details thereof.
Figure 2:
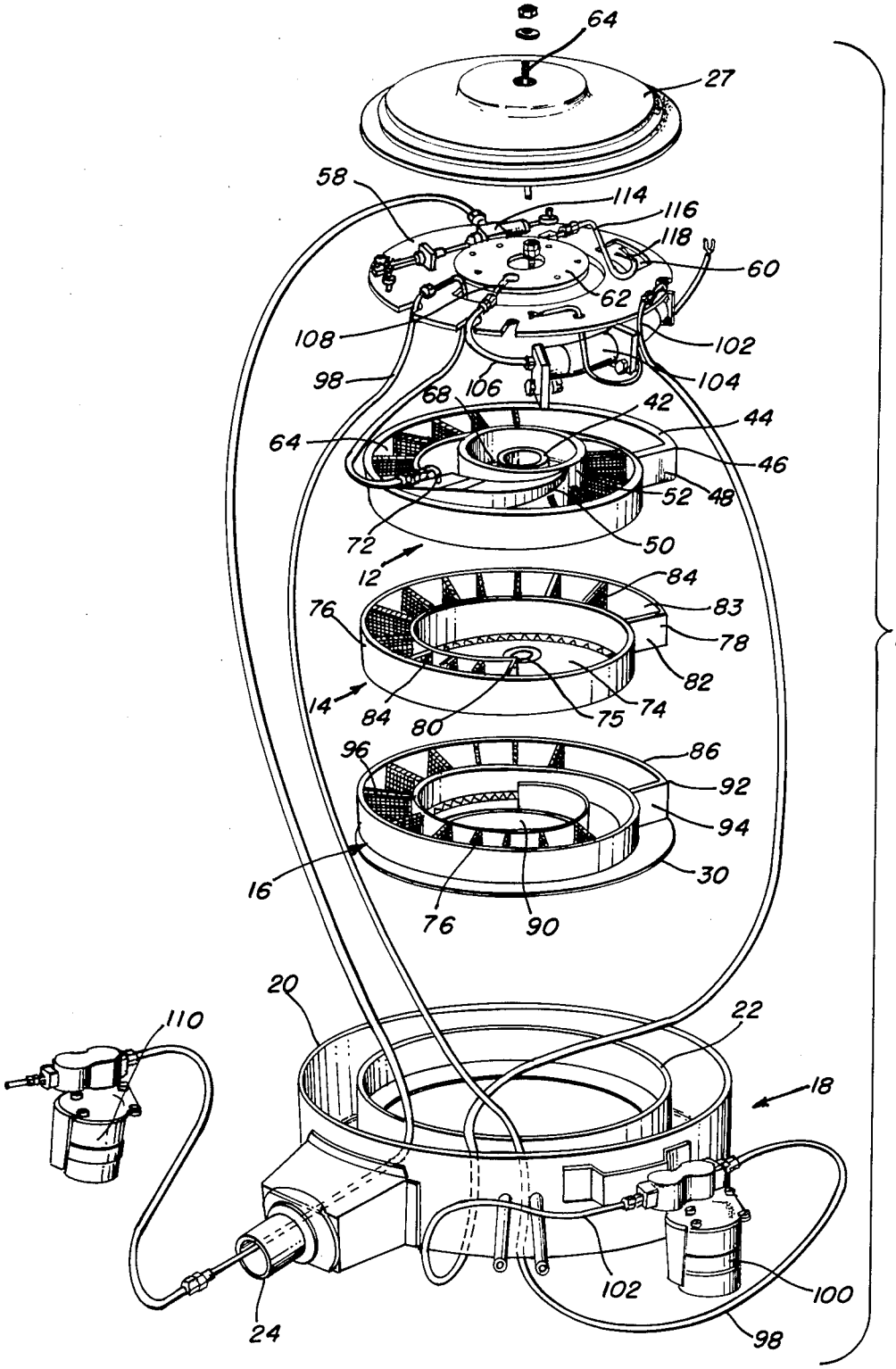
FIG. 2 is a disassembled perspective view of the carburetor and mounting shell of FIG. 1.

Referring now to the drawings, the preferred embodiment of a carburetor 10 constructed in accordance with the principles of the present invention is illustrated as having three main chambers or tray sections 12, 14, 16 defining respective mixing stages, the tray sections being mounted in tandem in vertically disposed abutting relationship with the tray 12 disposed on the tray 14 and the latter disposed on the tray 16. The assembly of trays, preferably bolted together, are disposed within a carburetor and air filter shell 18. The shell 18 may be constructed in a manner similar to those of the prior art but enlarged for receiving the enlarged carburetor of the present invention, and comprises an outer cylindrical wall 20 spaced from an inner cylindrical wall 22. An air inlet tube 24 communicates with the space between the walls 20, 22 through an enlarged bulbous protrusion on the exterior of the wall 20. A conventional air filter 26 may be mounted in the shell 18 between the walls 20 and 22 for filtering intake air received through the tube 24. A cover 27 secured to the top of the wall 20 encloses the assembly. Extending radially inwardly from the inner wall 22 at the lower end thereof is a lip 28 for supporting a flange 30 on the bottom of the lower-most tray of the carburetor, that being the third tray 16 in the preferred embodiment. The bottom of the shell 18 may be formed with a truncated conical base 32 having a central opening 34 which is disposed on the engine intake manifold casing 36 with the opening 34 communicating with the intake manifold portal.

Each of the tray sections 12, 14, 16 comprises a housing having a volute-like configuration including a base or floor portion and upstanding spiraling wall portions. The uppermost tray section 12 comprises a volute shape floor 38 having a central opening 40 within which an upstanding hollow tube 42 is secured. An upstanding wall 44 extends from the floor 38 spaced from the tube 42 at the outer periphery, extending from a leading edge 46 and continuing in a spiral fashion decreasing in radius and coiling toward but spaced from the tube 42 so as to form a fluid passageway between adjacent wall portions, the leading edge 46 being joined to the adjacent wall of the spiral by a wall 48. At approximately one and one-half coil loops from the wall 48, i.e., approximately 540° therefrom, the spiral wall 44 ascends upwardly at 50 and is bent to join an upstanding wall 52 forming the outer wall of a cyclonic funnel with the tube 42 forming the center of the funnel, the wall 52 being approximately twice the height of the remainder of the wall 44. The wall 52 is secured within an opening 53 forming the inner periphery of the floor 38 and has an aperture 54 formed at the upper portion where it is joined at 50 so as to communicate with the outer passageway, and a baffle 56 is formed along a portion of the aperture by, for example, bending the wall 52 inwardly at an elevation approximately equal to that of the wall 44. In this manner when a cover plate 58 is disposed on the upper edges of the coils of the wall 44 a fluid passageway is formed between the lower surface of the plate 58 and the respective coil of the spiral wall so that a fluid may be made to flow in a continuous spiral path from the outer spaced walls adjacent the wall 48 toward and entering the central portion through the aperture 54 over the baffle 56.

The cover plate 58 includes an inlet slot 60 at a location above the outer spaced walls and adjacent the wall 48 and a closure member 62 is disposed on top of the wall 52, a bolt 64 extending through the closure member 62 and the cover 27 to secure the assembly to the engine. Extending between walls of a portion of the spiral passageway are a plurality of turbulence producing vanes in the form of perforated or screen panels 66 which provide agitation of the fuel and air flowing in the passageway as hereinafter described for more complete vaporization and mixing of the fuel and air.

In the lower portion of the funnel, secured about the tube 42, is a plate 68 which is of a smaller diameter than the wall 52 so as to be spaced therefrom at the periphery, and preferably having a slight incline downwardly from the central portion toward the periphery. A second plate 70 is spaced below the plate 68 and secured about the lower peripheral edge of the tube 42 and bent in a conical configuration to join the floor 38 at its junction with the wall 52 but spaced from the plate 68. Thus, a central chamber or reservoir 71 is formed in the space between the plates 68 and 70 about the tube 42 which extends partly into the center of the second tray section 14 when the trays are assembled. A small tube 72 having one end in the bottom of the reservoir 71 extends upwardly from the tray through the wall, for reasons hereinafter made clear.

The second tray section 14 comprises a volute shape floor 74 having a small central opening 75 for receiving the bolt 64, and an upstanding wall 76 extends from the floor at the outer periphery from a leading edge 78 and continues in a spiral path coiling toward but spaced from the center and making approximately slightly more than one and one-half coil loops from the edge 78 so as to terminate at an edge 80. A small wall section 82 joins the edge 78 to the adjacent wall portion of the coil, and an opening 83 is formed in the floor 74 adjacent the leading edge 78 for communicating with the third tray section 16. The outer configuration and size of the wall 76 is substantially equal to that of the wall 44 of the first tray section so that the outer periphery of the top tray section 12 rests on that of the second tray section 14. Turbulence producing screens 84 similar to the screen 66 are disposed in the passageway between adjacent portions of the wall 76.

The third tray section 16 also has a volute shaped spiral wall 86 but the floor 88 is circular so as to form the flange 30 which is disposed on and seals with the lip 28 of the shell 18. The floor 88 includes an enlarged central aperture 90 which is superposed above the opening 34 of the shell when assembled therein. The wall 86 extends upwardly from the floor 88 at the outer periphery from a leading edge 92 in the same same manner as the walls 44 and 76 of the first and second trays respectively, extending from the leading edge 92 at the periphery and continuing spirally for approximately slightly more than two coil loops. A small wall section 94 joins the leading edge 92 to the ajacent wall portions, and a plurality of turbulence producing screens 96 are also disposed in at least a portion of the passageway defined between adjacent coil portions of the wall 86 in a similar manner to that of the trays 12 and 14. The configuration and size of the wall 86 is substantially equal to that of the wall 76 so that the three tray sections may be stacked while having superposed outer peripheral walls.

The free end of the tube 72 is connected in flow communication with a conduit 98 to the suction side of a pump 100, the pressure side of which is in turn connected to another conduit 102 which feeds a heater 104. The heater, which has the capability of heating fuel to a temperature of at least approximately 300° F., and may be an electric heater, has an outlet conduit 106 which is connected to a tube 108 which extends through the closure member 62 and is directed into the central tube 42 of the first tray section 13 for directing fluid into the second tray section 14.

A main fuel pump 110 is mounted in flow communication with gasoline in the fuel tank (not illustrated) and with a conduit 112 which may extend through the inlet tube 24 of the shell 18. The conduit 112 feeds a conventional fuel metering device 114, which may be a simple adjustable valve, the output of which feeds a conduit 116 having a spray nozzle 118 directed into the slot 60 of the cover plate 58 for spraying fuel into the inlet portion between the outer wall coils 44 adjacent the wall 48 of the first tray section 12. Inlet air which flows through the inlet tube 24 of the carburetor and air filter shell 18 passes through the air filter 26 and flows upwardly and is directed into the slot 60 as a result of the low pressure created by the engine inlet manifold.

As the gasoline spray and the intake air flow through the passageways defined between the wall coils 44 and through the turbulence producing screens 66 toward the center of the first tray section, the volatile liquids flash-off and mix with the air in the passageway. As the air and fuel flow through the aperture 54 over the baffle 56, the mixed air and fuel flow through the tube 42 of the cyclonic funnel down into the second tray section 14 while the heavier less volatile liquid fuel components which have not mixed with the air, together with fuel which condenses on the baffle, drop into the funnel between the tube 42 and the wall 48 and collect in the reservoir 71. The vapor which flows into the second tray section 14 flows in the passageway between the wall 76 from the central portion of this section toward the outside and thence flows through the opening 83 into the third tray section 16, and continues flowing in the passageway between the walls 86 toward the central aperture 90 and thence into the inlet manifold portal. The heavier liquid fuel which collects in the reservoir 71 is drawn out through the tube 72 by the pump 100 and is directed into the heater 104 where it is heated to the point of vaporization and thereafter flows through the conduits 106, 108 down into the tube 42 where it reenters the vaporization and mixing process in the center of the second tray 14. The heated vaporized fuel after entering the second tray section continues to flow toward the engine intake manifold with the more volatile gases that flow directly through the second and third tray sections from the first tray section.

Consequently, a carburetor is proposed which provides a substantially long flow path for the fuel molecules to have sufficient time to permeate the intake air, provide sufficient agitation of the fuel molecules and intake air as they flow through the turbulence producing screens to effect a more complete mixing of the fuel and air, and by separating the unvaporized heavy liquids from the readily vaporized liquids and recapturing and heating these heavy liquids to increase the molecular activity thereof, the carburetor provides a more efficient and effective vaporization of the fuel and mixing of the fuel with air than carburetors of the prior art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A carburetor for an internal combustion engine comprising a plurality of mixing chambers arranged vertically in tandem, each chamber having a floor and spirally extending passageways defined by spaced apart wall means upstanding from the floor leading from a peripheral portion of the respective chamber to a central portion thereof, a first of said chambers having a substantially centrally disposed hollow tube communicating with the passageway of a second next adjacent chamber, said second chamber having an outlet in the passageway at the outer periphery thereof communicating with the passageway of a third chamber adjacent to and below the second chamber, and said third chamber having an outlet in the central portion thereof, a cyclonic funnel formed in the first chamber defined by an annular wall spaced about said hollow tube and an opening in said annular wall communicating with the passageway of the first chamber, means defining a reservoir in said first chamber between said hollow tube and said annular wall for collecting liquid fuel separated in said cyclonic funnel, a conduit communicating with said reservoir, a heater disposed outside said carburetor for receiving and heating liquid fuel so separated, means for communicating the heated liquid fuel with the upper end of said hollow tube for delivery of said heated fuel to the second chamber, cover means on said first chamber for closing the top thereof, said cover means having an aperture communicating with a peripheral portion of the passageway of said first chamber, means for spraying fuel into said aperture, and a housing for supporting said chambers with the lowermost chamber communicating with the intake manifold of said engine and for directing air into said aperture, whereby air and fuel may flow through the pasageways of said first chamber and continue through the second and third chambers while unmixed heavy fuel components may collect in said reservoir, be heated and returned through said hollow tube into said second chamber.

2. A carburetor as recited in claim 1, wherein said passageways include turbulence producing elements disposed therein for uniformly mixing the fuel and air flowing therethrough.

3. A carburetor as recited in claim 2, wherein said turbulence producing elements comprise perforated screen panels spaced apart in the passageways.

4. A carburetor as recited in claim 1, wherein said heater heats the heavy separated fuel components to a temperature of at least 300° F.

5. A carburetor as recited in claim 1, wherein said opening in said annular wall is disposed at an elevation above the top of said hollow tube, and means forming a baffle disposed at a lower margin of said opening for aiding in directing vaporized fuel and air into said hollow tube and heavy fuel component into said funnel.

6. A carburetor as recited in claim 1 including pump means for drawing fuel from said reservoir through said heater to said hollow tube.

7. A carburetor as recited in claim 1, wherein the floor of said first chamber closes the top of the passageway of said second chamber and the floor of said second chamber closes the top of the passageway of said third chamber.

8. A carburetor as recited in claim 7, wherein said passageways include turbulence producing elements disposed therein for uniformly mixing the fuel and air flowing therethrough.

9. A carburetor as recited in claim 8, wherein said turbulence producing elements comprise perforated screen panels spaced apart in the passageways.

10. A carburetor as recited in claim 8, wherein said opening in said annular wall is disposed at an elevation above the top of said hollow tube, and means forming a baffle disposed at a lower margin of said opening for aiding in directing vaporized fuel and air into said hollow tube and heavy fuel component into said funnel.

11. A carburetor as recited in claim 10, wherein said turbulence producing elements comprise perforated screen panels spaced apart in the passageways.

12. A carburetor as recited in claim 11, wherein said heater heats the heavy separated fuel components to a temperature of at least 300° F.

13. A carburetor for an internal combustion engine comprising a plurality of mixing chambers arranged vertically in tandem, each chamber having spirally extending mixing passageways, the uppermost chamber having an inlet for air and fuel disposed in a peripheral portion of the passgeway therein and an outlet at a central portion thereof, the lowermost chamber having an inlet for an air and fuel mixture disposed at a peripheral portion of the passageway thereof and an outlet at a central portion thereof, at least one other chamber disposed intermediate said uppermost and lowermost chambers, each chamber adjacent the uppermost and lowermost chambers having an inlet for air and fuel mixture at the central portion of the passageway thereof and an outlet at a peripheral portion thereof so that air and fuel mixed in said uppermost chamber may flow in a spiral path of decreasing radius in said uppermost chamber toward the center and enter the next adjacent chamber at a central portion thereof and flow thereafter in a spiral path of increasing radius and eventually may enter into the lowermost chamber and flow in a spiral path of decreasing radius to exit the outlet thereof, means defining a cyclonic funnel disposed about the outlet of the uppermost chamber for separating heavy unmixed fuel components from the air and fuel mixture exiting the uppermost chamber, a reservoir for collecting the heavy fuel components separated in said funnel, a heater disposed outside the chambers of said carburetor, means for drawing said heavy fuel components from said reservoir and feeding said components to said heater for heating said components to a temperature of at least approximately 300° F., and means for directing said heavy fuel components from said heater to the outlet of said uppermost chamber for mixing in the subsequent chambers with the remainder of the fuel and air mixture.

14. A carburetor as recited in claim 13, wherein said passageways include turbulence producing elements disposed therein for uniformly mixing the fuel and air flowing therethrough.

15. A carburetor as recited in claim 14, wherein said turbulence producing elements comprise perforated screen panels spaced apart in the passageways.

* * * * *

UNITED STATES PATENT AND TRADEMARK OFFICE

CERTIFICATE OF CORRECTION

PATENT NO. : 4,715,346

DATED : December 29, 1987

INVENTOR(S) : Ray William Stephens, Jr.

It is certified that error appears in the above-identified patent and that said Letters Patent is hereby corrected as shown below:

Cover page, item [76] change "Inventor: Beth R. Dempsey" to -- Inventor: Ray William Stephens, Jr. - Beth R. Dempsey, Administratrix of the estate --

Signed and Sealed this

Twenty-ninth Day of March, 1988

*Attest:*

*Attesting Officer*

DONALD J. QUIGG

*Commissioner of Patents and Trademarks*